US007278699B2

(12) United States Patent
Drake et al.

(10) Patent No.: US 7,278,699 B2
(45) Date of Patent: Oct. 9, 2007

(54) ENHANCED PRINTER RELIABILITY USING EXTRA PRINT MODULE

(75) Inventors: Donald J. Drake, Rochester, NY (US); Jeffrey J. Folkins, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 328 days.

(21) Appl. No.: 11/094,420

(22) Filed: Mar. 31, 2005

(65) Prior Publication Data

US 2006/0227157 A1 Oct. 12, 2006

(51) Int. Cl.
*B41J 29/38* (2006.01)

(52) U.S. Cl. ..... 347/13; 347/42; 347/12

(58) Field of Classification Search ..... 347/19, 347/23, 42–43, 12, 13
See application file for complete search history.

(56) References Cited

U.S. PATENT DOCUMENTS

| | | | |
|---|---|---|---|
| 5,179,418 | A | 1/1993 | Takamiya et al. |
| 5,192,959 | A | 3/1993 | Drake et al. |
| 5,581,284 | A | 12/1996 | Hermanson |
| 5,587,730 | A | 12/1996 | Karz |
| 6,089,693 | A | 7/2000 | Drake et al. |
| 6,462,764 | B1 | 10/2002 | Kubelik |

FOREIGN PATENT DOCUMENTS

| | | |
|---|---|---|
| JP | A 04-276446 | 10/1992 |
| JP | A 04-315914 | 11/1992 |

*Primary Examiner*—Lam Son Nguyen
(74) *Attorney, Agent, or Firm*—Oliff & Berridge, PLC

(57) ABSTRACT

Methods and apparatus for extending the reliability and usefulness of a fullwidth printhead by providing a redundant temporary replacement printhead module that can be positioned to compensate for missing or faulty jet nozzles. In order to take advantage of a single extra printhead module and to be able to compensate for more than a single failed nozzle, the replacement module is mounted on a separate translating x-axis and preferably provided with roll adjustment along another axis so that an effective spacing of nozzles in the replacement module can be adjusted to align with detected defective nozzles. The fullwidth printhead is formed from at least one array of smaller printhead modules. The arrays may be offset by a non-integer spacing interval of the individual nozzles. For example, if the nozzle spacing is S, the offset may be S/2. By virtue of the x-translation and roll capabilities, a single replacement module can accommodate replacement of one or several defective nozzles spaced closer together than the total length L of the replacement module, even if the defective nozzle(s) are located on different printhead modules and have a non-integer spacing.

18 Claims, 9 Drawing Sheets

ENHANCED PRINTER RELIABILITY USING EXTRA PRINT MODULE

BACKGROUND

The disclosure relates to methods and apparatus for extending the reliability and usefulness of a full width printhead by providing a redundant temporary replacement printhead module that can be positioned to compensate for missing or faulty jets.

Printers using full width printheads (i.e., printbars) are known and offer several advantages over conventional printheads that must travel back and forth across a print medium to achieve printing of a page. Advantages include faster printing speed, quieter operation, improved reliability due to less moving parts, etc. However, full width printheads suffer from certain drawbacks.

One particular drawback is a problem with defective nozzles. High productivity printers achieve enhanced productivity by employing a large number of nozzles. However, more nozzles result in greater opportunity for nozzle failure. For instance, a full width ink jet printhead array spanning a typical 8.5" wide sheet of paper may have 7200 or more discrete individual jet nozzles, each of which must operate properly for the printer to produce a quality print. The problem is increased in high speed production architecture ink jet systems that can have a combined printhead width of up to 24" or more.

Partially due to manufacturing limitations and partially to reduce the cost of replacement, many pagewidth or full width printheads use a number of smaller replaceable printhead modules rather than a large single head. The printhead modules are either butted together to form a single linear array, or offset and staggered in length to provide full width functionality. Such full width printheads may also include multiple printhead modules arranged in series (but offset by a partial pixel width to achieve an effective increase in resolution of the head itself).

For example, a prototype 24" full color printer uses a first set of 32 modules (eight (8) three inch (3") long 300 dpi staggered print modules for each of four colors C, Y, M, and K) to achieve 300 dpi printing. A second set of 32 printhead modules is offset by ½ pixel from the first set to effectively double the resolution of the printhead assembly to 600 dpi. Thus, 64 total printhead modules are present. This represents a total of 57,600 individual nozzles in the full width, full color printhead array. Having such a large number of individual jets increases the probability that any single ink jet will fail. This, coupled with very high printer usage in high speed production makes the probability and frequency of nozzle failure a significant problem.

A simplified example of this is shown in FIG. 1, which represents a single color printbar 100 having a first set 200 of printhead modules 200A-D and a second set 300 of printhead modules 300A-D. The first set 200 includes individual modules 200A-D that each contain a plurality of nozzles 210 spaced by a center-to-center distance S. The second set 300 similarly includes individual modules 300A-D that each contain a plurality of nozzles 310 spaced by a distance S. However, the nozzles in the second set 300 are offset from the nozzles in the first set 200 by a spacing S/2. This effectively creates a composite array with twice the resolution (i.e., an effective spacing of S/2) of the individual printhead modules.

In this simplified example, a defective nozzle 220 is present within printhead module 200B. As is evident from the vertical lines, nozzles from the offset printhead module 300B do not overlap with the single defective nozzle 220 shown. Accordingly, once at least one defective nozzle is present, the collective printbar 100 consisting of various printhead modules with nozzles is no longer capable of reproducing a complete image. Instead, the printbar 100 will print with a band or streak at the location of the defective nozzle where no printing can occur. Thus, once one or more nozzles become defective, image quality suffers.

Failed ink jet detection systems are known in the art. Such technologies include, for example, drop sensors that recognize missing or misdirected drops. One such drop sensing device uses a light beam that is projected across the width of the printing medium and between the printhead and the printing medium to a detector. Based on the timing and degree of occlusion caused by an ink droplet passing through the light beam, the device can sense the size and directional accuracy of the ink droplets. A laser may also be provided for such detection. Examples of suitable detectors include U.S. Pat. No. 5,179,418, the subject matter of which is hereby incorporated herein by reference in its entirety, as well as Japanese Patent Publication No. 4-315914 and Japanese Patent Publication No. 4-276446.

Even though nozzle failures, such as defective nozzle 220, can be detected, no practical method exists to repair individual failed printheads, other than minor problems that can be fixed through routine cleaning or maintenance. Rather, typical repair requires a complete replacement of the printhead module containing one or more defective print nozzles. This, however, is problematic for at least three reasons. First, the failed printhead module is typically thrown away, which represents a significant investment in cost, even though only a single nozzle or jet may be defective. Second, a replacement printhead may not be readily available, which can increase printer down time. Third, typical replacement and necessary alignment must be performed by a qualified technician, which requires additional printer down time to schedule and complete the replacement. Particularly when the printer involved is used for high volume production runs, there is a very high cost associated with the necessity to stop the current production run and make such necessary printhead repairs.

Various methods and attempts to improve the reliability of such printers are known, including for example, those disclosed in U.S. Pat. No. 5,581,284 to Hermanson, U.S. Pat. No. 6,089,693 to Drake et al., U.S. Pat. No. 6,462,764 to Kubelik, and U.S. Pat. No. 5,587,730 to Karz. Each of these four patents is commonly assigned to Xerox Corporation and hereby incorporated herein by reference in their entireties.

SUMMARY

There is a need for a more cost-effective system to compensate for defective ink jets.

There also is a need for a system and method that can extend the life of a printer before servicing or printhead replacement is necessary.

There further is a need for a system and method that can enable compensation for defective ink jets on an array that includes nozzles with different alignment offsets using only a single replacement module.

To provide redundancy at reduced cost, various exemplary embodiments provide one or more extra temporary replacement printhead modules in addition to the modules already provided to achieve fullwidth printing. These one or more replacement modules are not necessarily used during normal operation of the device and instead are mainly activated when one or more nozzles in the primary printhead modules are determined to be defective.

If the circumstances are that the printhead module with a failure has more than one defective jet, this extra temporary spare module can obviously operate to replace two or more jets in the defective module.

In order to take advantage of a single extra printhead module and to be able to compensate for more than a single failed jet, it is also possible that the module can be located to compensate for failed jets in two or more modules. If the modules are adjacent modules and the distance between failed jets is less than the length of the replacement printhead module, the module can be aligned to cover both defective jets. Alternatively, additional print passes could be added to compensate for more defective jets if they are not closely spaced.

In order to further take advantage of a single extra printhead module and to be able to compensate for more than a single failed jet, it is also possible that the module can be provided with roll capability around at least one axis to compensate for failed jets in different modules having non-aligned or non-uniform spacing.

In various exemplary embodiments, at least one extra printhead module is mounted on a separate translating x-axis or is otherwise adjustable along the x-axis. This architecture requires the addition of only a single printhead module because the x-axis translation ability allows alignment with any of the nozzles of the full width array.

In various exemplary embodiments, one replacement module can be positioned to compensate for two or more missing jet nozzles. In a preferred embodiment, the replacement module can be rotated or rolled about one axis in addition to x-axis translation to align with one or more defective ink nozzles. This may be particularly useful when defective nozzles are on modules that are offset or otherwise non-aligned with other printbar modules.

When one or more jets of a full width printhead is irreparably lost or otherwise defective, the jet(s) can be automatically detected by a suitable jet detector. An example of such known detection can be found, for example, in U.S. Pat. No. 6,089,693 to Drake et al. At this time, the printing process can be temporarily stopped and a spare temporary replacement printhead module moved into an x-direction position that covers the missing jet. The printing process can then be restarted and the printing of the image covered by the defective nozzle can be achieved using a nozzle from the spare replacement printhead module aligned with the defective nozzle. Conventional image processing techniques can provide the substituted drop by compensating the timing and placement of the replacement drop based on the known positional orientation of the spare replacement printhead module. This enables continued operation of the printer without the need for an extended stop to perform a complete replacement of a defective printhead module.

Although printing could proceed indefinitely through use of the spare module, the defective printhead module may be replaced at an appropriate time, such as after completion of a production run or until service can be scheduled. At this time, it may not be necessary to purchase or install a new printhead module. Rather, because the temporary spare module only needs to have at least one jet that fires, the first time the "replacement" printhead module is used, it can itself be used to replace the defective printhead module having one or more defective nozzles. Then, the defective printhead module can be mounted as the new "replacement" temporary spare printhead module. This "replacement" module can theoretically be used for the life of the product, since it only needs to have one operational jet to serve its purpose as a temporary spare.

The provision of more than one redundant print head module will further increase the average time between repairs of the printer. However, each added printhead adds additional cost and complexity.

BRIEF DESCRIPTION OF THE DRAWINGS

Exemplary embodiments will be described with reference to the drawings, wherein.

DETAILED DESCRIPTION OF EMBODIMENTS

The disclosure is directed to compensating missing or defective elements in spot imaging reading and/or writing bars. In particular, it pertains to full width array raster input scanning (RIS) and raster output scanning (ROS) bars. These are formed from either a single full width array or more preferably a series of relatively short modules assembled together to have a requisite length and number of elements to scan or write an entire line of information with a high image resolution. In exemplary embodiments, the spot imaging bars are writing devices, preferably liquid ink jet printers, but can also include reading devices, such as LED bars.

Exemplary printers can be of the continuous stream or drop-on-demand types, such as piezoelectric, acoustic, phase change wax-based or thermal, and have at least one printhead containing an array of nozzles from which droplets of ink are directed toward a medium, such as paper. The particular type of ink jet delivery methodology is not of particular concern, so long as temporary replacement printhead modules are compatible for use with any failed printhead modules in the main array.

Figure 1:
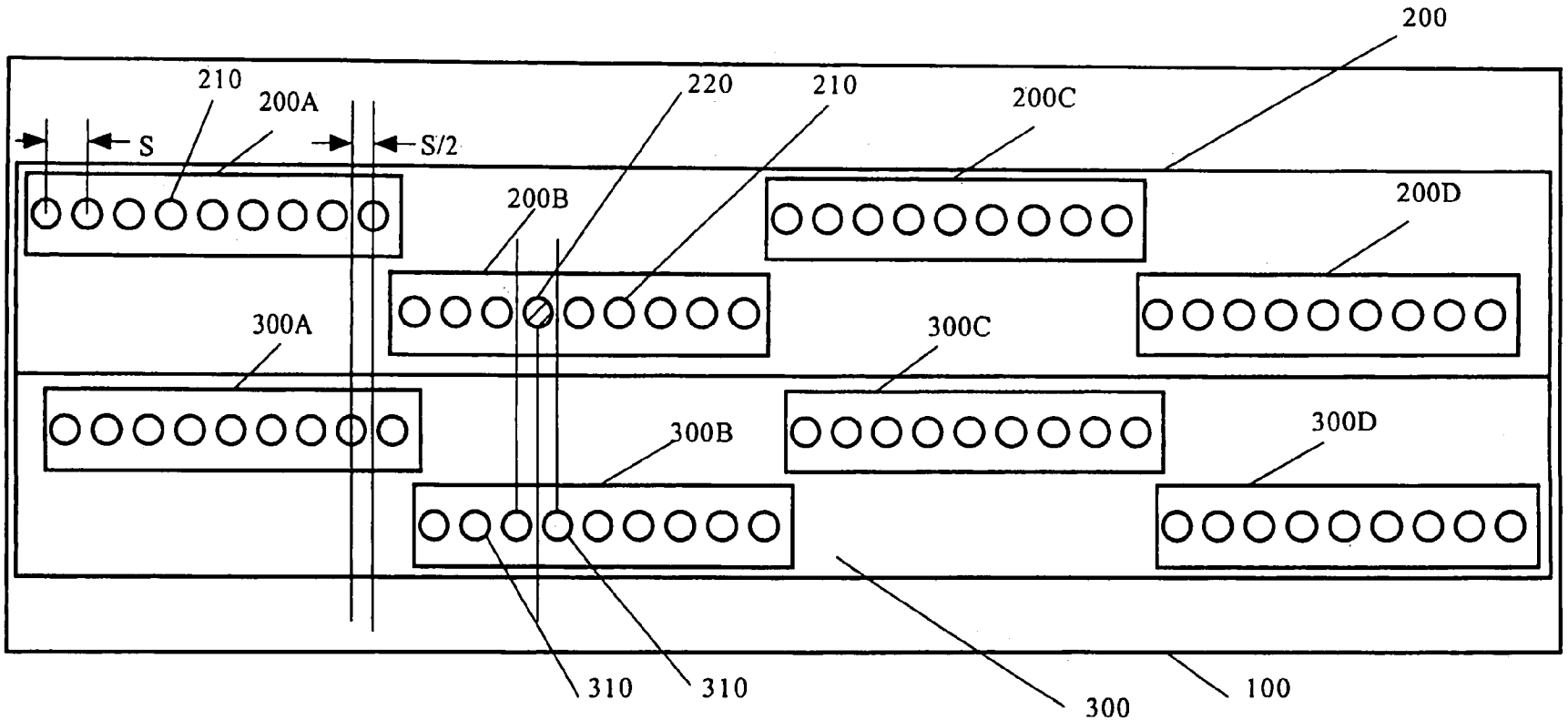
FIGURE 1 RELATED ART
FIG. 1 illustrates an enlarged, schematic front view of a typical full width printbar made up of a plurality of individual printhead modules and including a defective jet nozzle.
Figure 2:
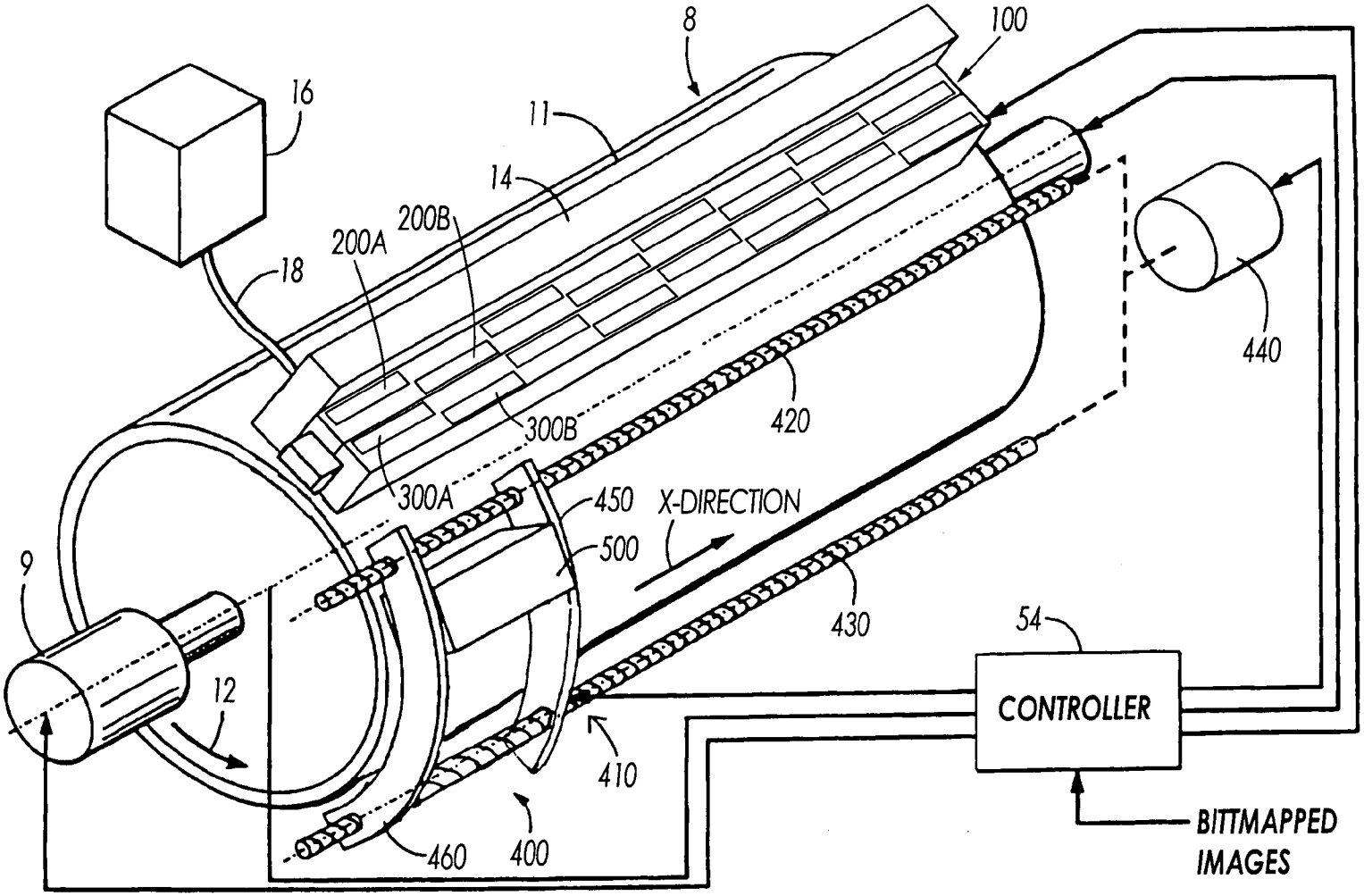
FIG. 2 illustrates a partially shown, isometric view of a full width array ink jet printer to which the printbar of FIG. 1 can be provided.

FIG. 2 illustrates an exemplary embodiment of an ink jet printer 8 including a pagewidth or large array black print bar 100 positioned to deposit ink on a curved recording medium placed on a rotating drum 11, which is rotated by a multiple speed motor 9 and which rotates the drum 11 in the direction of an arrow 12 at selected different speeds. The print bar 100 has been assembled similar to that shown in FIG. 1 to have a first set of staggered modules or printhead dies 200A, 200B, etc. and a second set of staggered modules or printhead dies 300A, 300B, etc. that are offset from the first set. The modules are assembled and aligned to form an extended width array as known in the art having a plurality of individual nozzles or jets. The nozzles are selectively energized to expel an ink droplet from the associated nozzle. The ink channels are coupled into a common ink manifold 14 mounted along and attached to the print bar 100 in sealed communication with the ink inlets of the channel dies through aligned openings. The manifold 14 is supplied with the appropriate ink, black in this example, from an ink container 16 through flexible tubing 18 attached thereto.

In addition to the single color print bar 100 printing black ink, additional full width array printheads may be provided for printing a respective color, for instance cyan, magenta, and yellow. The appropriate ink can be supplied to the associated printhead by inclusion of an attached printhead ink tank coupled to the printheads themselves or by ink containers attached to the printheads through flexible tubing as used in connection with the black printbar. Alternatively, multicolor printheads could be utilized whereby two or more colors coexist within the same printhead. In this case, the alignment replacement jets on the replacement head would of course have to be of the same color as any given defective jet.

To print an image, a controller 54 receives bit map images from a print driver which is either resident in the printer or is resident in an image generating device such as a personal computer, or a combination of the two. The bit mapped images are manipulated by the controller 54 such that the appropriate signals are transmitted to the printbar 100. The drive signals generated by the controller 54 are conventionally applied via wire bonds to drive circuitry and logic on each of the printhead dies 200A, 200B, 300A, 300B, etc. of each printbar 100 (and any optional color printbars). Signals include pulsing signals that are applied to heat generating resistors or transducers formed in the heater dies or any other conventional or subsequently developed structure used by the printbar to eject ink from a select nozzle.

The controller 54 may take the form of a microcomputer including a central processing unit, a read-only memory for storing complete programs and a random access memory. The controller 54 also controls other machine functions such as rotation of the drum 11 and movement of a positioning device 440 (to be described later in detail) associated with a carriage 410 to advance a temporary replacement printhead module 500 in position to compensate for missing or defective jets in the printbar 100.

Defects resulting from the failure of certain nozzles to eject ink during the printing process can generate images that are unacceptable. Such defects are considered a significant failure mode and can result in a user not printing with the printer until the non-printing nozzle is remedied either through a maintenance operation or by replacement of the printbar.

In view of such printing defects, various embodiments provide a defective nozzle detection system 90 (FIG. 3), and at least one replacement printhead module 500 mounted on a translating carriage assembly 410 used to compensate for one or more missing or defective jets. The defective nozzle detection system 90 detects which of the nozzles are not printing, and provides information that can be used by controller 54 to moving a properly functioning nozzle of the replacement printhead module 500 into alignment with the detected missing nozzle(s). The controller 54 also then sends image information to the properly functioning nozzle to fill in the missing image information from the defective nozzle(s), and prints the missing image information with the functioning nozzle(s).

The carriage assembly 400 includes a translatable carriage 410 that is driven by lead screws 420 and 430 by a drive motor 440. The carriage 410 includes curved frame members 450 and 460, which support at least one temporary replacement printhead module 500. Carriage 410 may include threaded apertures through which the lead screws 420 and 430 are threaded. The carriage 410 moves in the X-direction shown to traverse the printer parallel to the length of the printbar 100 and perpendicular to a direction of paper advancement. The replacement printhead module 500 can be conventional in construction and fabricated in accordance with the same techniques used to form individual print modules 100A within printbar 100. In preferred embodiments, replacement modules 500 are identical to modules 100A and are thus suitable for eventual permanent replacement of malfunctioning printhead modules 100A.

Figure 3:
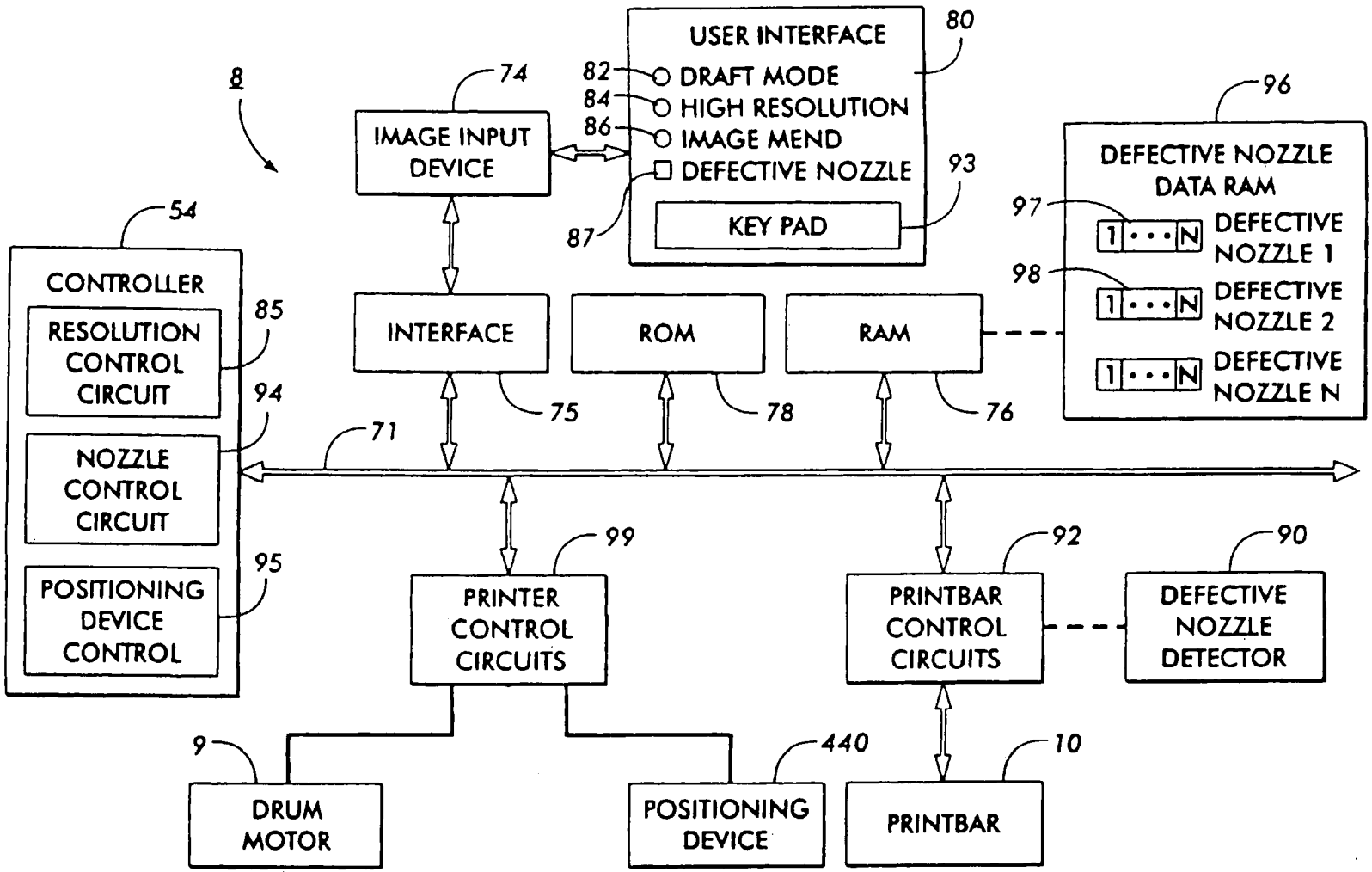
FIG. 3 illustrates a schematic circuit diagram of a control system for the printer of FIG. 2.

FIG. 3 illustrates a printing system, including the printer 8, which not only provides for determination of a missing nozzle, but which can also provide the capability of compensating for defective nozzles. The controller 54 is coupled to a bus 71 for transmission of image information and/or control signals between a plurality of printer devices and an image input device 74. The image input device 74 includes a number of known image generators that generate image information in the form of various image description languages such as the known Page Description Language (PDL) and Postscript. The image input device could, for instance, include a personal computer, a computer workstation, a computer coupled to a scanner, or other known image input devices. The input image device 74 is coupled through a connecting bus to an interface 75 of the printer which provides for a compatible interchange of the image information generated by the image input device to the printer. The interface 75 is connected to the bus 71 and transmits image data and control data to the controller or to a Random Access Memory (RAM) 76 under the direction of the controller 54. The printer, in addition, includes a Read Only Memory (ROM) 78 that includes sufficient memory for the storage of predetermined operating system or controlling programs such as is known by those skilled in the art. The controller 54 includes a plurality of circuits that enable the printer 8 to fill in missing data on a printed page, which occurs because of one or more defective nozzles.

When a defective nozzle is discovered through use of defective nozzle detector 90, a user may consider whether to continue printing. A user interface 80 may be provided, which typically appears on a display device, for instance, a cathode ray tube or liquid crystal display of the image input device 74. The user interface may include the selection of two or more document resolutions. For instance, the user interface 80 may include a draft mode selector 82 and a high resolution mode selector 84 which, once selected, are transmitted to a resolution control circuit 85. In addition, the user interface may include an image mend selector 86 that enables the user to select the option of filling in the missing data on a printed page due to one or more defective nozzle(s).

Suitable selectors can include pushbuttons, touch sensitive screens, or mouse selectable items in menus as non-limiting examples. If the user does not select the image mend selector 86 function, the user can either decide not to print with the printer until the defective nozzle is corrected (i.e., stop current usage of the printer) or continue to print at reduced image quality (i.e., while retaining the current detected nozzle defect(s)). It is also possible to include a defective nozzle visual indicator 87 in the user interface. The indicator 87 indicates to the user that one or more defective nozzles are present. In various embodiments, the printing system may include a default setting where once a defective nozzle is identified, the system automatically enters the image mend mode 86 until otherwise changed by the user. This can allow near seamless automatic compensation for faulty jets.

If the user selects the image mend selector 86 (or the feature is automatically enabled), then a signal responsive thereto is transmitted from the image input device 74 over the bus 71 to the controller 54. Either prior to selection or in response thereto, defective nozzle detector 90 identifies which of the nozzles are defective. The defective nozzle detector 90 is incorporated as part of printbar control circuits 92, which are coupled to the printbar 100. In one example of a defective nozzle detector, the defective nozzle detector circuit detects when there is no current being carried by a particular drop ejector, which would indicate, for instance, an open heater or thermal transducer. It is also possible that other defective nozzle detection devices including ink sensing conductors placed within a channel could be used. In addition, a print of a diagnostic test pattern could be made to manually assess missing or faulty jets. The test pattern would allow the user to identify to the machine which of the nozzles are non-functioning. For instance, if the printer does not include nozzle detectors, the printbar could print a test pattern including nozzle identifiers, such as a number, which is printed by each of the functioning nozzles and which identifies a nozzle. The printer might print a test pattern responsive to a user selecting the image mend selector 86. The missing number or numbers would indicate to the user which of the nozzles is non-functioning. The user would then input the nozzle number or numbers into the printer controller through, a user input device, such as a keypad 93, of the user interface 80.

Once the defective nozzle(s) have been identified, the information is accessed by the controller 54 and is used by a nozzle control circuit 94. The nozzle control circuit 94 provides a plurality of functions, which include enabling the storage of the identity of one or more defective nozzles as well as the direction of the storage of image data corresponding to a defective nozzle in a defective nozzle data RAM 96. RAM 96 can be included in the RAM 76 or separately embodied. The nozzle control circuit 94, upon receipt of the identity of the defective nozzle, would cause the defective data RAM to store appropriate data, which cannot be printed during printing of the image due to the defective nozzle. For instance, if there are two defective nozzles, then the image data, which is not printed by the first defective nozzle is stored in a plurality of registers 97. This data, for example, corresponds to a single column of information wherein the image data for every pixel location of the column is stored for each of the lines of the missing column of the printed image. The second defective nozzle data is stored in a register 98.

During image processing, the controller 54 and the nozzle control circuit 94 transmits the stored image data from the RAM 96 to a suitable selected replacement nozzle for printing. The selected replacement nozzle could be determined as a function of the moving capabilities provided by the positioning device 440 or may be selected as a function of a distance measured in nozzle spacing from the defective nozzles. For instance, if a single nozzle is determined to be defective, the replacement printhead module 500 may be moved by a predetermined distance under control of the positioning device control circuit 95 of the controller 54. The positioning device control circuit 95 transmits a signal representative of the desired nozzle spacing or the movement thereof to a printer control circuit 99 that is coupled to the positioning device 440. After the positioning device control circuit 95 has transmitted a signal over the bus 71 to cause the positioning device 440 to move a predetermined distance from the defective nozzle, the controller 54 retrieves the defective nozzle data from the RAM 96 such that the data is printed by the replacement printhead module 500.

Figure 4:
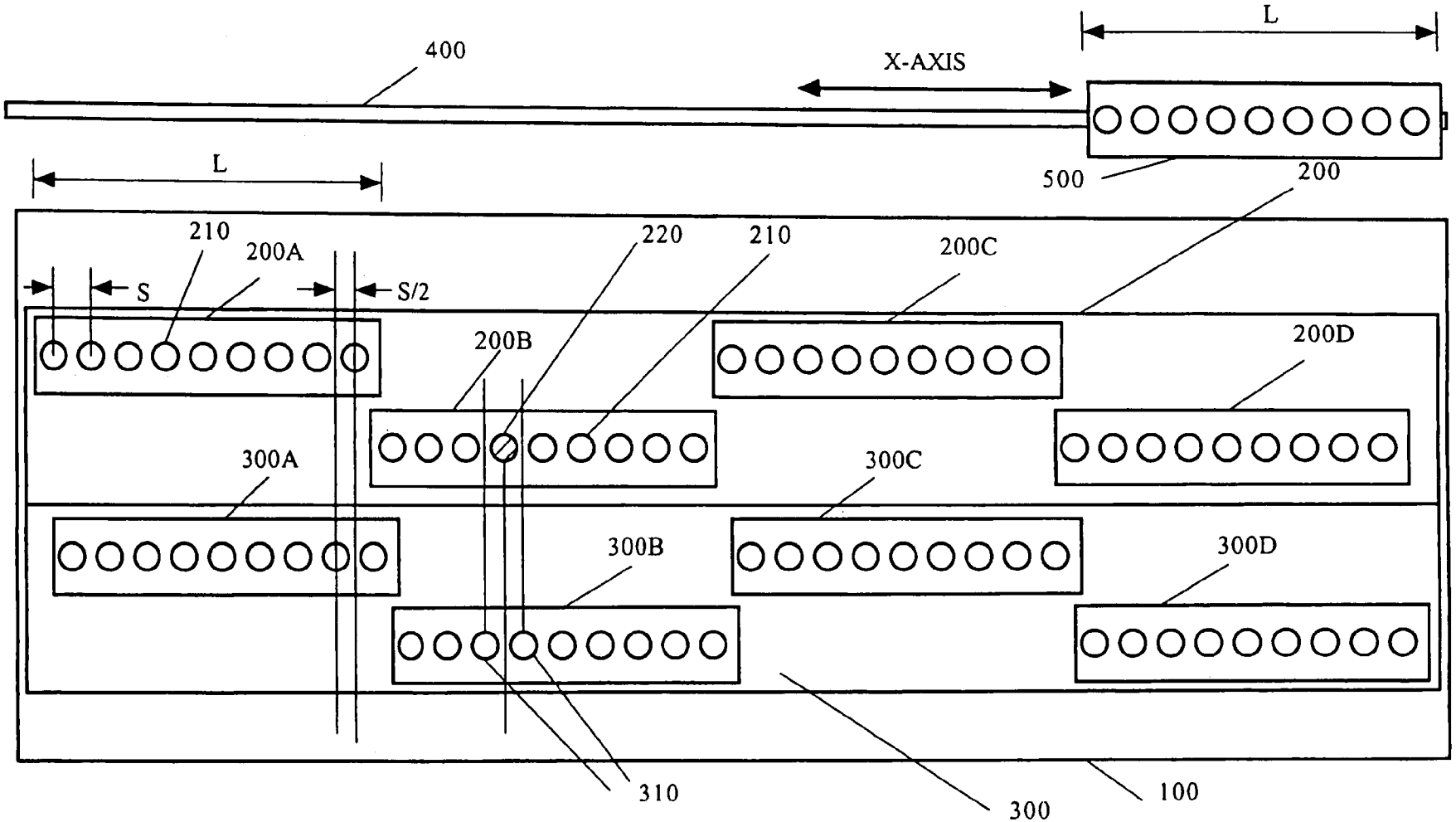
FIG. 4 illustrates an enlarged, schematic front view of a full width printbar further including a translating replacement printhead module in the printer of FIG. 2.

FIG. 4 is a schematic diagram of an exemplary printbar 100 that includes a defective nozzle 220 that has failed to eject ink along a pixel line that is parallel to the moving direction of the recording medium. FIG. 4 also shows carriage assembly 400 and temporary replacement printhead module 500 at a non-use position, such as located at one extreme of the carriage assembly. In a single color (i.e., monochrome) application, only one such printbar 100 may be provided. In a multicolor printer, four such printbars may be needed, one for each of Cyan, Yellow, Magenta and black (C, Y, M, K). Additionally, to increase resolution, multiple arrays of each color may be provided in series, but laterally offset by a fraction of the individual nozzle spacing.

In this particular example, printbar 100 is for a single color, such as black, and includes two serially oriented printbar arrays 200 and 300. The first printbar array 200 has four individual printhead modules (200A, 200B, 200C, and 200D), each having a length L that collectively provide a full width array extending the length of the printer (e.g., 4×L) and have a uniform nozzle spacing of S. The second printbar array 300 also has four individual printhead modules (300A, 300B, 300C, and 300D) that collectively provide a full width array extending the length of the printer and has a uniform nozzle spacing of S. However, because second printbar 300 is offset from the first printbar 200 by a distance of S/2, the individual nozzles 210 of the first array do not overlap with corresponding nozzles 310 of the second array. Thus, for example, if the spacing S corresponds to 300 dpi (dots per inch), the combination of printbars 200 and 300 will result in an effective doubling of the resolution to 600 dpi. While shown to have four modules in each array, this is a non-limiting example. Any number of modules may be present in each array.

Various methods of printer operation will be described with reference to FIGS. 5-9. A first method will be described with reference to FIGS. 5-7. The method starts at step S5000 where the process advances to step S5010 and image input data is received from a suitable source, such as from a scanner or electronic file. At step S5020, a routine to detect defective nozzle jets is performed. If no defective jets are detected, the process advances from step S5030 to S5040 where a normal print operation is performed. If, however, one or more defective jets are detected, the process advances to step S5060 where it is determined if all of the defective jets are within a length L of the temporary printhead module. If not, the process advances to step S5070 and displays a fault. At this point, the user may choose at step S5080 to stop the current print job by proceeding to step S5050, or continue printing, albeit with defective nozzles, by proceeding to step S5040.

If however, all defective jets are determined to be within length L in step S5060, the process advances to step S5090 where the image data is extracted for the defective jet(s). Flow then advances to step S5100 where the temporary replacement printhead module is positioned in line with the missing jet(s). Flow then advances to step S5110 where the extracted data from the defective jet(s) is sent to predetermined nozzles of the replacement module. Flow then advances to step S5120 where a temporary print mode operation is performed. During this temporary operation, properly functioning jets are printed as normal and the missing or defective jet(s) are printed by aligned nozzles in the temporary replacement printhead module through suitable timing and control of the image printing process. From step S5120, flow advances to step S5050 where the process stops.

Figure 5:
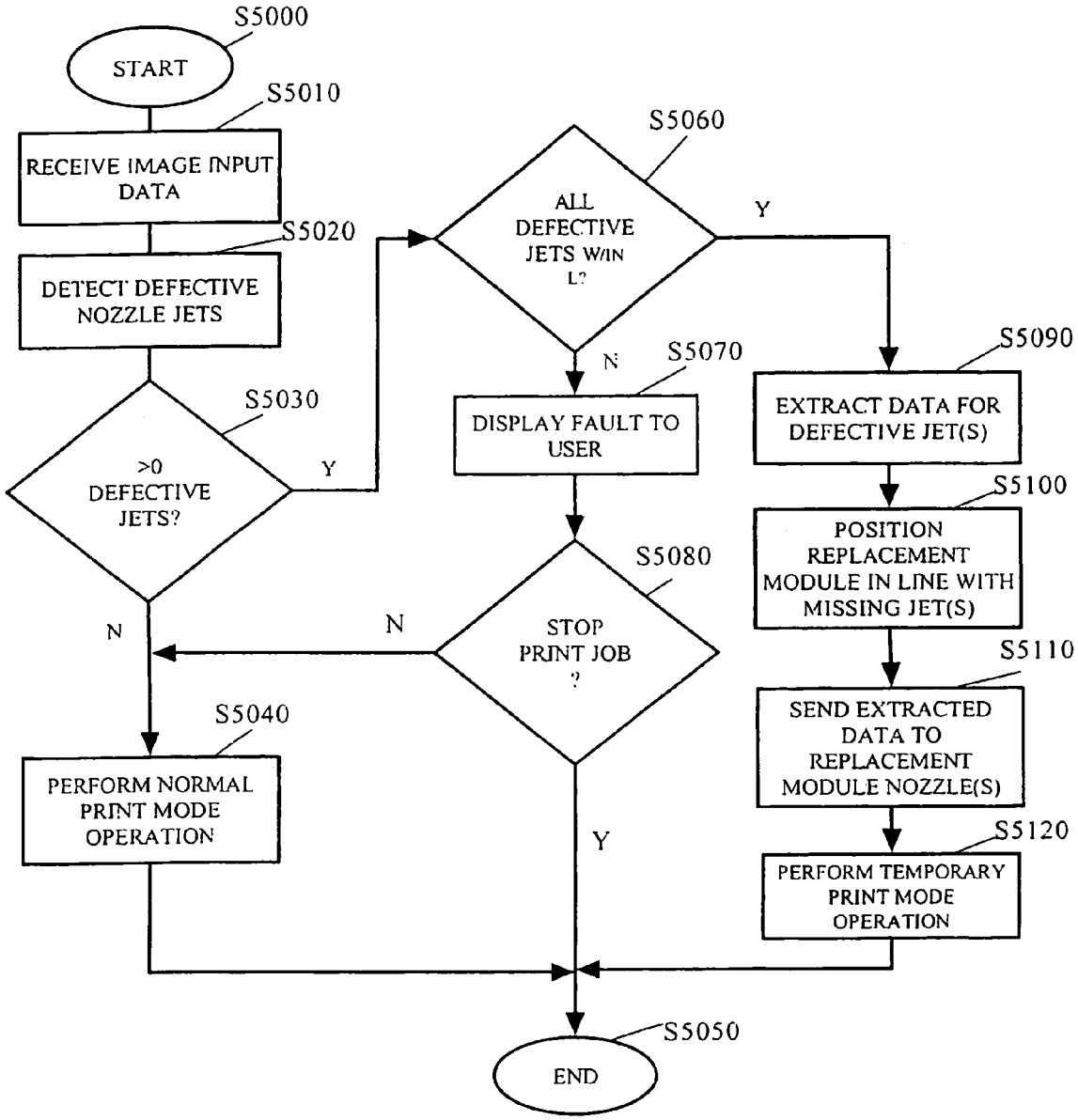
FIG. 5 illustrates a flow chart that achieves correction of a limited number of missing jets according to a first exemplary embodiment.
Figure 6:
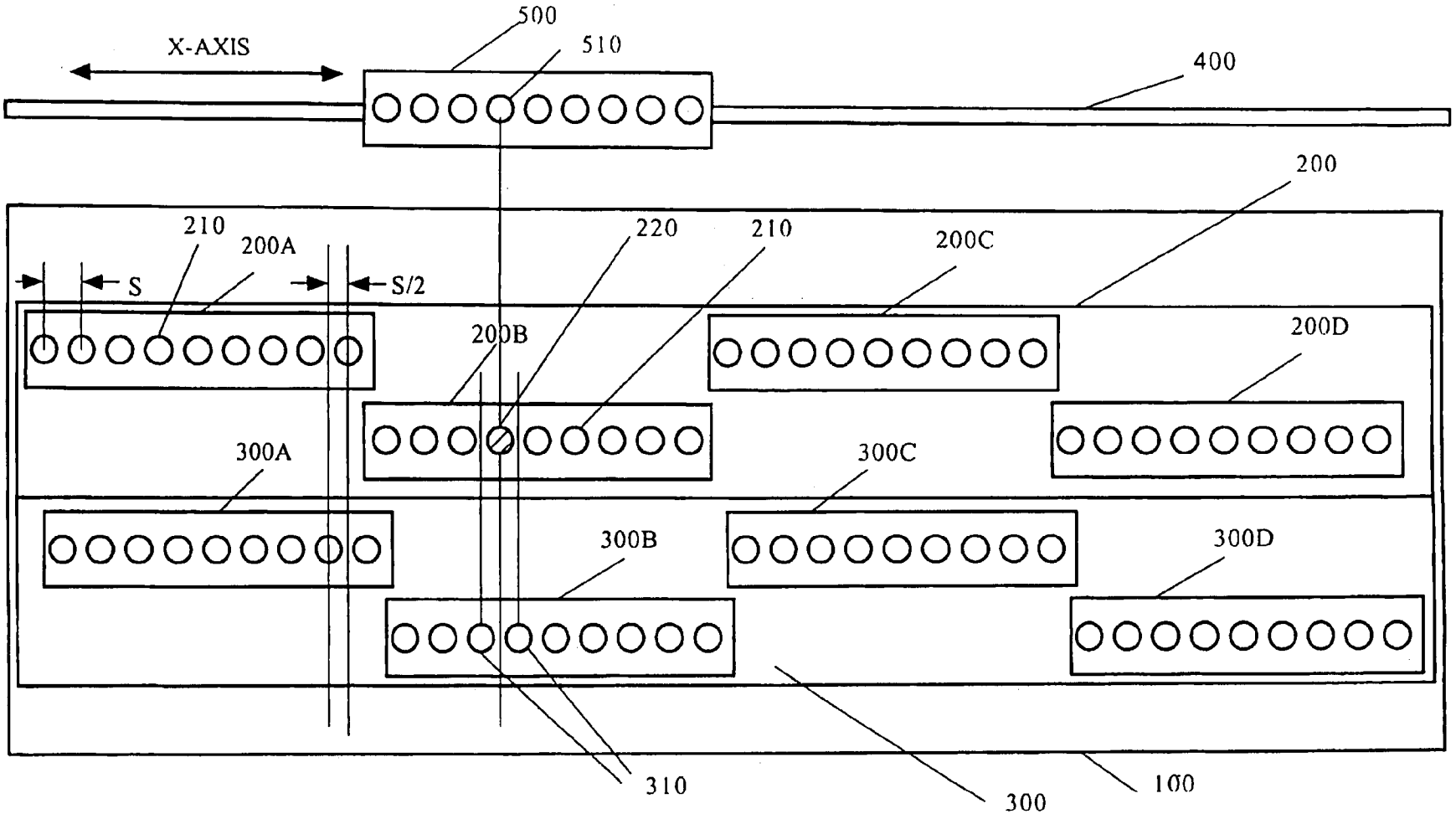
FIG. 6 illustrates an enlarged, schematic front view of the printbar of FIG. 4 showing a defective print nozzle after the replacement printhead module has been translated into a position to compensate for a single defective print nozzle.
Figure 7:
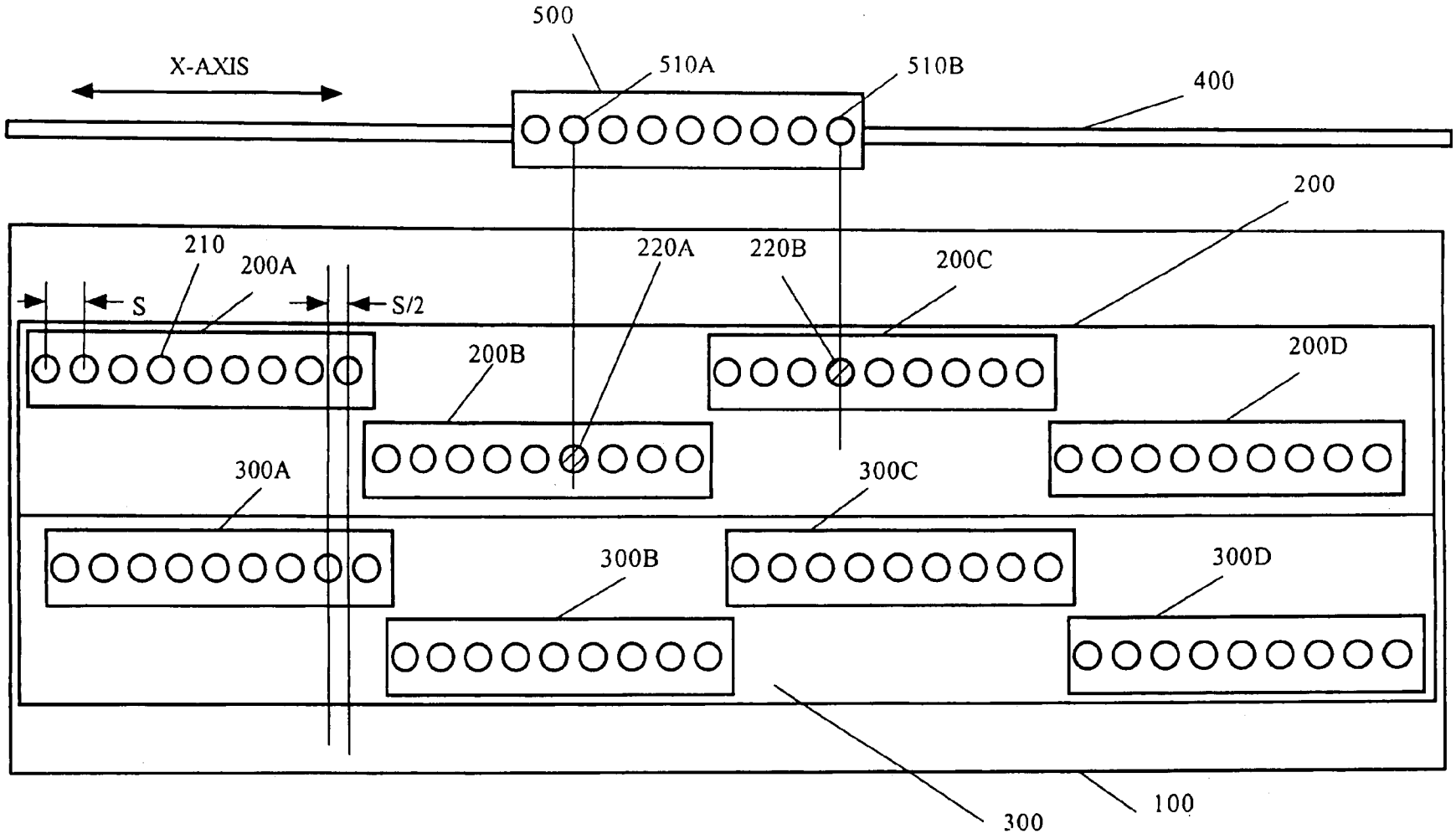
FIG. 7 illustrates an enlarged, schematic front view of the printbar of FIG. 4 showing two defective print nozzles on adjacent print modules after the replacement module has been translated into a position that compensates for both defective print nozzles.

Thus, during the method of FIG. 5, replacement printhead module 500 can be positioned as shown in FIG. 6 to align a nozzle 510 of the replacement module with a defective nozzle 220 from the printbar 100. Additionally, as shown in FIG. 7, if more than one defective nozzle is detected and the defective nozzles are within the width of the replacement printhead module 500, the module 500 can be aligned to replace two or more defective jets, even if they exist on different printhead modules of the printbar. For example, here defective jets 220A and 220B from module 200B and 200C, respectively, are replaced by replacement nozzles 510A and 510B from replacement printhead module 500.

Figure 8:
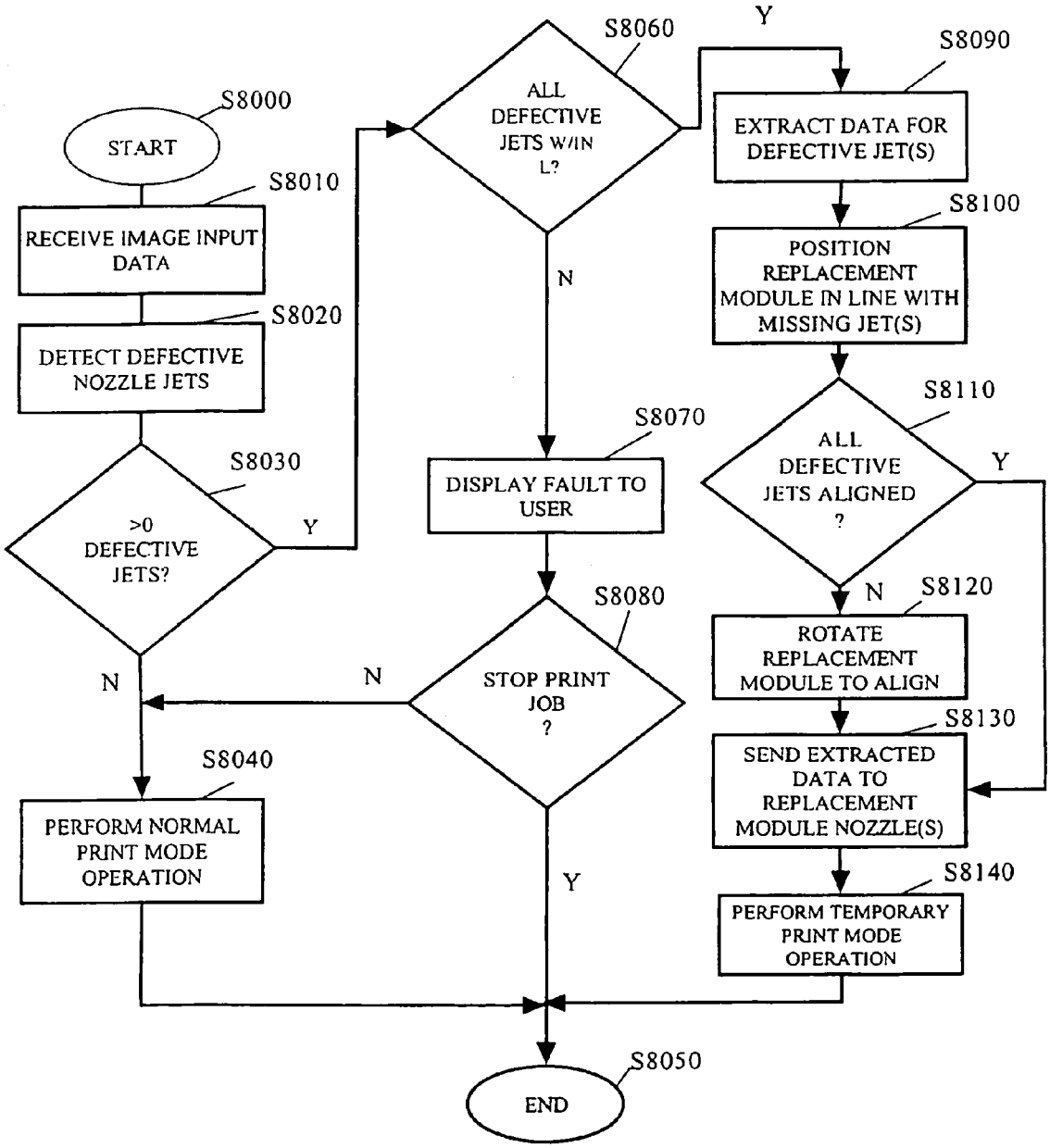
FIG. 8 illustrates a flow chart that achieves connection of missing jets having non-aligned spacing according to a second exemplary embodiment.
Figure 9:
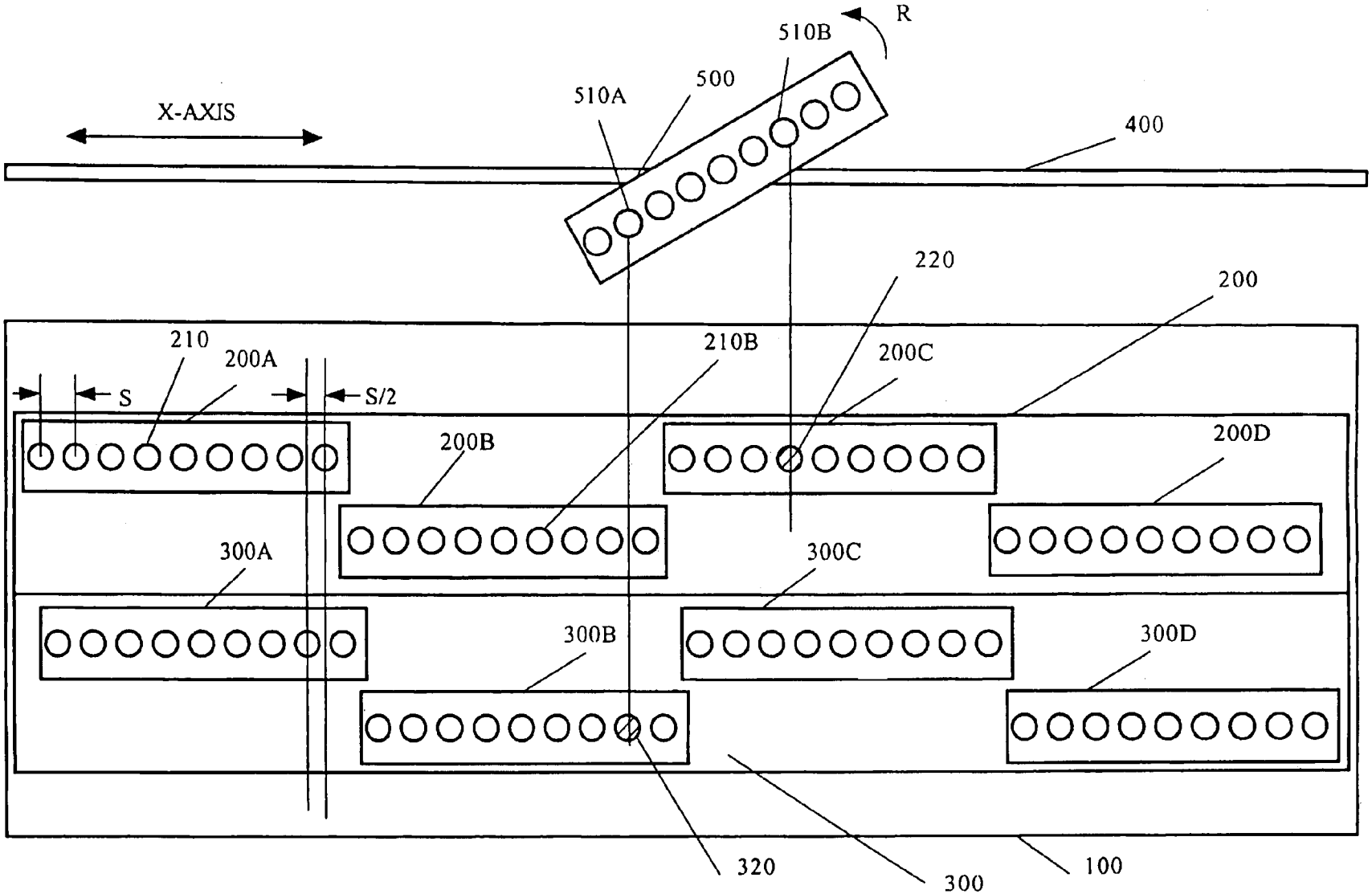
FIG. 9 illustrates an enlarged, schematic front view of the printbar of FIG. 4 showing two defective print nozzles on different offset print modules having dissimilar nozzle spacings.

A second method of operation will be described with reference to FIGS. 8-9. In this example, the printbar 100 includes first array 200 and second array 300 that are offset by a spacing of S/2 as shown in FIG. 9. As also shown, one or more defective nozzles may be present on either array 200 or 300 (i.e., defective nozzles 220 and/or 320). Because of the possibility of failure of either of multiple offset or otherwise non-aligning or non-uniformly spaced nozzles, it may be desirable to provide two separate replacement modules, one capable of alignment with each printhead array spacing and orientation. However, this requires an extra redundant printhead module, which adds cost and processing complexity.

This embodiment provides a mechanism in which a single replacement printhead module 500 can be used and aligned to either array 200 or 300 and may even be adjusted to compensate one or more defective jets on each of two non-aligned modules 200 and 300. This is possible through a slight roll of the printhead module 500 about a roll axis in a direction R as shown. Thus, besides the ability to translate in the X-axis, the replacement module can be rotated slightly about a roll axis in direction R (which may be counterclockwise as shown or clockwise) to adjust the effective spacing between replacement nozzles to other than an even pitch spacing of S and to better align the replacement module with a defective jet.

For example, in FIG. 9, two defective nozzles are shown (nozzle 220 on module 200C and nozzle 320 on module 300B that are separated in the X-axis by a spacing other than an integer multiple of S (i.e., 9S/2 in this example). Because of this, a translating nozzle array 500 having a common spacing S may be unable to accommodate compensation for one or the other defective nozzles in both modules. That is, due to movement constraints in the X-axis, alignment may be achieved with one module, but not necessarily the other because of the non-uniform or offset spacing. However, by allowing slight rotation of the module, replacement module 500 can be readily aligned with one or more defective nozzles, regardless of whether the defective nozzle is on the first array 200 or the second offset array 300. In this example, module 500 can be aligned to have nozzles 510A and 510B that align with defective nozzles 320 and 220, respectively.

For example, when the replacement printhead module has nozzles arranged in a known sawtooth layout arranged on a diagonal, a nozzle spacing S that results in 300 dpi, and a module length of about 3 inches, a printhead module roll in axis R of at little as 10 m radians can cause a shift in spacing between a far left nozzle and a far right nozzle of a sawtooth of 42 μm, which corresponds to 1/600 dpi. In the illustrated example of a spacing S that corresponds to 300 dpi nozzle spacing, results in the ability to accommodate alignment with a spacing that is a multiple of S/2 as illustrated in FIG. 9. Similar results can be achieved using a straight nozzle array as shown in the simplified drawings. The roll would be similarly adjusted based on known geometric relationships to achieve a desired effective nozzle spacing between nozzles 510A and 510B.

An example of a method of correction using this structure will be described with reference to FIG. 8. The method starts at step S800 and advances to step S8010 where image input data is received. From step S8010, flow advances to step S8020 where defective nozzle jets are detected. If no defective jets are detected, the process advances from step S8030 to S8040 where a normal print operation is performed. If, however, one or more defective jets are detected, the process advances to step S8060 where it is determined if all of the defective jets are within a length L of the temporary printhead. If not, the process advances to step S8070 and displays a fault. At this point, the user may choose at step S8080 to stop the current print job by proceeding to step S8050, or continue printing, albeit with defective nozzles, by proceeding to step S8040.

If however, all defective jets are determined to be within length L in step S8060, the process advances to step S8090 where the image data is extracted for the defective jet(s). Flow then advances to step S8100 where the temporary replacement printhead module is positioned in line with the missing jet(s). Flow then advances to step S8110 where it is determined whether all defective jets are aligned with corresponding nozzles of the replacement printhead module. If they are, flow advances to step S8130 where the extracted data from the defective jets is sent to predetermined nozzles of the replacement module. Flow then advances to step S8140 where a temporary print mode operation is performed. During this temporary operation, properly functioning jets are printed as normal and the missing or defective jets are printed by aligned nozzles in the temporary replacement printhead module through suitable timing and control of the image printing process. From step S8140, flow advances to step S8050 where the process stops.

However, if it is determined at step S8110 that all defective jets are not aligned, flow advances to step S8120 where replacement module 500 is slightly rotated about axis R until defective nozzle(s) are properly aligned with a replacement nozzle of module 500. From step S8120, flow advances to step S8130. Alignment can be achieved through use of adjustment tables, known mathematical geometric relationships, or through automated or manual visual inspection and subsequent calibration or adjustment. Thus, with only a single replacement module having nozzles with a spacing S, defective nozzles on two different modules that have non-uniformly aligned nozzles can be compensated for.

Although printing could proceed indefinitely through use of the spare replacement module 500, the defective printhead module (200 or 300) may be replaced at an appropriate time, such as after completion of a production run or when service can be scheduled. At this time, it may not be necessary to purchase or install a new printhead module in the array. Rather, because the temporary spare module only needs to have at least one jet that fires, the first time the "replacement" printhead module 500 is used, it can itself be used to replace the defective printhead module (200 or 300) having one or more defective nozzles. Then, the defective printhead module (200 or 300) can be mounted as the new "replacement" temporary spare printhead module 500. This "replacement" module can theoretically be used for the life of the product, since it only needs to have one operational jet to serve its purpose as a temporary spare. All that is required is knowledge of the location of defective jet(s) so that the replacement module can be suitably positioned to have an operable jet aligned with defective jet(s) in the main printbar array.

While the various described circuits 85, 94, and 95 have been identified as part of the controller 54, these circuits can be separate from the controller. In addition, the controller 54 as well as the described circuits 85, 94, and 95 can be embodied as hardware, software, or firmware. It is known and commonplace to program and execute imaging, printing, document, and/or paper handling control functions and logic with software instructions for conventional or general purpose microprocessors. This is taught by various prior patents and commercial products. Such programming or software may of course vary depending on the particular functions, software type, and microprocessor or other computer system utilized, but will be available to, or readily programmable without undue experimentation from, functional descriptions, such as those provided herein, or prior knowledge of functions which are conventional, together with general knowledge in the software and computer arts. That can include object oriented software development environments, such as C++. Alternatively, the disclosed system or method may be implemented partially or fully in hardware, using standard logic circuits or a single chip using VLSI designs.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the following claims.

What is claimed is:

1. A method of extending the life of a fullwidth printbar in an ink jet printer using a temporary replacement module that has a length L less than the fullwidth printbar and a plurality of aligned nozzles separated by a spacing S, comprising:

monitoring the printbar for defective nozzles;

identifying defective nozzles within the printbar;

positioning the temporary replacement module by translating the replacement module in a direction parallel with the length of the printbar to a position where individual nozzles within the replacement module align with at least two of the defective nozzles;

extracting data from an image to be printed corresponding to data that would be printed by the identified defective nozzles; and printing the image using non-defective nozzles from the printbar and individual nozzles of the replacement module that align with and correspond to the at least two defective nozzles, wherein the printbar is made up of an array of printhead modules, each printhead module also having a length L and a plurality of nozzles having a predefined spacing, the array of printhead modules including at least two printhead modules that are aligned relative to each other with a nozzle spacing that is not an integer multiple of S, the method further comprising identifying at least two defective jets having a spacing therebetween that is not an integer multiple of S; and positioning the temporary replacement module through a combination of translation parallel with the length of the printbar and rotation about at least one other axis to adjust the effective spacing between nozzles in the temporary replacement module to align with the at least two identified defective jets.

2. The method according to claim 1, wherein the predetermined spacing between adjacent nozzles in each printhead module is S and at least one printhead module in the array is offset from another printhead module in the array by a non-integer multiple of S, and wherein one of the at least two defective jets is located on the at least one offset printhead module.

3. The method according to claim 2, wherein at least one defective nozzle is located on each of two separate printhead modules.

4. The method according to claim 1, wherein when the defective nozzles are separated by a distance less than L, the temporary replacement module is positioned to align a nozzle of the replacement module with each defective nozzle.

5. An ink jet printer, comprising:

a fullwidth printbar formed from at least two arrays of aligned printhead modules and oriented in a lengthwise direction, each array containing a plurality of printhead modules, each module containing a plurality of individual printhead nozzles having a predetermined spacing S, one of the at least two arrays being offset relative to another by a non-integer multiple of S;

a translating carriage that translates parallel to the length direction;

a temporary replacement printhead module mounted to the translating carriage for movement therewith, the temporary replacement printhead module being adjustably rollable about a roll axis R perpendicular to the length direction to adjust the effective spacing between nozzles in the temporary replacement printhead module to be a non-integer multiple of S;

a defective nozzle detector mechanism that can identify defective nozzles within the printbar;

a printer control circuit that positions the temporary replacement module to align at least one individual nozzle of the temporary replacement module to an identified defective nozzle within either of the at least two arrays of the printbar by movement of at least one of the translating carriage and roll of the temporary replacement printhead module about the R axis.

6. The ink jet printer according to claim 5, wherein the printbar is made up of an array of printhead modules, each printhead module also having a length L and a plurality of nozzles having a predefined spacing S.

7. The ink jet printer according to claim 5, wherein the printer control circuit positions the temporary replacement module to align at least one individual nozzle with at least one defective jet located on the at least one offset printhead module.

8. The ink jet printer according to claim 5, wherein when defective jets are located on two separate printhead modules of the printbar, the printer control circuit adjusts at least one of carriage translation and replacement module roll to align individual nozzles of the replacement module with defective nozzles on the two separate printhead modules.

9. The ink jet printer according to claim 8, wherein one of the printhead modules having one or more defective nozzles is offset from another of the printhead modules having one or more defective nozzles.

10. The ink jet printer according to claim 5, wherein when the defective nozzles are separated by a distance less than L, the temporary replacement module is positioned to align a nozzle of the replacement module with each defective nozzle.

11. The ink jet printer according to claim 5, wherein the replacement printhead module is the same size as printhead modules within the printbar, and the defective printhead module can be replaced with the replacement printhead module and the defective printhead module can be mounted where the temporary replacement module was originally located so that when the defective printhead module has at least one operating nozzle, the defective printhead module can be used as a temporary replacement module by aligning at least one operating nozzle in the temporary printhead module with a defective nozzle in the printbar.

12. A method of extending the life of a fullwidth printbar in an ink jet printer using a temporary replacement module that has a length L less than the fullwidth printbar and a plurality of aligned nozzles separated by a spacing S, comprising:

monitoring the printbar for defective nozzles, the printbar including at least two arrays of printhead modules, each array having a plurality of printhead modules having a plurality of nozzles spaced apart from adjacent nozzles by a predetermined spacing S as measured in a direction parallel to the length of the printbar, a second array being offset from the first array by a spacing that is a non-integer multiple of S;

identifying at least one defective nozzle within the printbar;

positioning the temporary replacement module by translating the replacement module in a direction parallel with the length of the printbar and by roll of the temporary replacement module about a roll axis to a position where individual nozzles within the replacement module align with the at least one defective nozzle on either the first array or the second array;

extracting data from an image to be printed corresponding to data that would be printed by the identified at least one defective nozzle; and printing the image using non-defective nozzles from the printbar and at least one individual nozzle of the replacement module that aligns with and correspond to the at least one defective nozzle.

13. The method according to claim 12, further comprising identifying at least two defective jets having a spacing therebetween that is not an integer multiple of S; and positioning the temporary replacement module through a combination of translation parallel with the length of the printbar and rotation about at least one other axis to adjust the effective spacing between nozzles in the temporary replacement module to align with the at least two identified defective jets.

14. The method according to claim 13, wherein the offset is S/2 and when two defective jets are separated by a distance that is a multiple of S/2, the temporary replacement module is rolled about the axis to adjust the effective spacing between corresponding replacement nozzles of the temporary replacement printhead module to a multiple of S/2.

15. The method according to claim 12, wherein the predetermined spacing between adjacent nozzles in each printhead module is S and at least one printhead module in the array is offset from another printhead module in the array by a non-integer multiple of S, and wherein one of the at least two defective jets is located on the at least one offset printhead module.

16. The method according to claim 12, wherein at least one defective nozzle is located on each of two separate printhead modules.

17. The method according to claim 12, wherein when the defective nozzles are separated by a distance less than L, the temporary replacement module is positioned to align a nozzle of the replacement module with each defective nozzle.

18. The method according to claim 12, further comprising replacing a defective printhead module having at least one defective nozzle with the replacement printhead module;

mounting the defective printhead module at the location where the temporary replacement module was originally located;

identifying defective nozzle locations of the defective printhead module; and using the defective printhead module as a temporary replacement module by aligning at least one operating nozzle in the temporary printhead module with a defective nozzle in the printbar.

* * * * *